US005785519A

United States Patent [19]

Becker et al.

[11] Patent Number: 5,785,519

[45] Date of Patent: Jul. 28, 1998

[54] STRUCTURE FOR A FIRING TABLE

[75] Inventors: Friedherz Becker, Wendelstein; Andreas Böttcher, Nürnberg; Johannes Figel, Schwaig; Hans-Georg Hartmann; Volker Rieck, both of Nürnberg; Bernd Stender, Fürth, all of Germany

[73] Assignee: Riedhammer GmbH, Nuremberg, Germany

[21] Appl. No.: 696,925

[22] PCT Filed: Feb. 16, 1995

[86] PCT No.: PCT/DE95/00189

§ 371 Date: Aug. 16, 1996

§ 102(e) Date: Aug. 16, 1996

[87] PCT Pub. No.: WO95/22733

PCT Pub. Date: Aug. 24, 1995

[30] Foreign Application Priority Data

Feb. 18, 1994 [DE] Germany ..... 44 05 269.3

[51] Int. Cl.[6] ..... F27D 5/00

[52] U.S. Cl. ..... 432/258; 432/259

[58] Field of Search ..... 432/236, 246, 432/258, 259

[56] References Cited

U.S. PATENT DOCUMENTS

| | | | |
|---|---|---|---|
| 1,492,188 | 4/1924 | Young | 211/135 |
| 3,739,921 | 6/1973 | Schmidt | 211/177 |
| 4,013,403 | 3/1977 | Petrus | 432/246 |

FOREIGN PATENT DOCUMENTS 9301095 5/1993 Germany .

*Primary Examiner*—Henry A. Bennett
*Assistant Examiner*—Gregory Wilson
*Attorney, Agent, or Firm*—John F. A. Earley; John F. A. Earley, III; Harding, Earley, Follmer and Frailey

[57] ABSTRACT

The invention relates to a structure for a firing table to accept ceramic items to be fired.

2 Claims, 2 Drawing Sheets

STRUCTURE FOR A FIRING TABLE

This appln is a 371 of PCT/DE95/00189 filed Feb. 16, 1995.

FIELD OF THE INVENTION

The present invention pertains to a structure for a firing table for carrying especially ceramic items to be fired, such as sanitary porcelain, dishes, or the like.

BACKGROUND OF THE INVENTION

Various types of kilns have been known for firing such items. Tunnel kilns and roller kilns as representatives of continuously operating kilns, as well as hood type kilns or bogie hearth kilns as representatives of intermittently operating kilns are of particular significance.

There is a special problem in connection with the loading and unloading of the items to be fired on or from a corresponding support especially in the case of the firing of sensitive items, such as porcelain. The support usually comprises a kiln car in the case of a tunnel kiln and, e.g., a plate in the case of a roller kiln. The various supports will hereinafter be collectively called a firing table.

Various constructions have been known for this purpose, which comprise essentially props, on which plates lie, and the items to be fired are placed on the said plates. A plurality of such units comprising props and plates are assembled one on top of another (prospectus of the Göbel-Werk GmbH, GroBalmerode, Germany, 1985).

The loading and unloading are always performed manually. It is difficult to place on and remove the item to be fired, especially in the case of items located in the middle, because the distance between the individual plates is kept as short as possible to increase the amount of items that can be accepted for firing. It is sometimes even necessary to build up the so-called kiln furniture, i.e., the props and plates, anew for each kiln pass and to disassemble them at the end of the kiln.

Besides the above-mentioned firing bench structure, encapsulation of the item to be fired has been known as well. Plates are placed, e.g., into a capsule one by one, and a plurality of capsules may be arranged one on top of another. It is obvious that this process for loading a firing table is also extraordinarily expensive and can usually be performed only manually.

Props for placing on ceramic items to be fired have been known from, e.g., U.S. Pat. No. 3,137,910 A, DE 28 44 281 A1, and DE 35 16 490 A1. Every individual part is placed on a separate prop, which may have, e.g., the shape of a tripod.

DE 27 17 784 A1 describes a car for a tunnel kiln, in which the car has a support device for items to be fired, which comprises crossbeams with grooves. Rollers which form a roller plane are located in the grooves, and the rollers are rotatable via a common drive. The crossbeams are said to consist of metal. The items to be fired can be placed on this prior-art car in one layer only. Consequently, only a very small amount of items to be fired can be placed on the car, and the setting density is therefore unsatisfactory. A metal shelf with loading planes consisting of rotatable rollers is described in FR-A-1,544,901.

A static structure consisting of props, hollow tubes, tubes and cassettes is described in DE 93 01 095 U1.

SUMMARY OF THE INVENTION

The basic object of the present invention is to provide a firing table structure which simplifies the loading and unloading of the items to be fired such that the loading and unloading can preferably be performed in a mechanized manner. The smallest possible mass of firing aids (kiln furniture) as well as the highest possible setting density are also desirable in order to make possible energy-saving operation.

The present invention is based on the consideration that an absolutely "static" firing table structure, i.e., an arrangement of the kiln furniture in which each part maintains its fixed place between assembly and disassembly, can be replaced with a "mobile" firing table structure, which can nevertheless have a plurality of levels and thus makes possible a high setting density.

One idea is to use the individual firing table planes as conveying means.

The items to be fired or the corresponding support plate shall no longer be put in place or removed individually manually or mechanically.

This can be achieved in a new firing table structure by the items to be fired themselves or the corresponding support plate sliding onto or off the planes of the firing table structure during loading and unloading.

In its most general embodiment, the present invention consequently pertains to a structure for a firing table for accepting ceramic items to be fired, having the features of claim 1.

The firing table structure thus resembles a shelf with roller floors, but the rollers are not driven here continuously, as will be described in greater detail below.

Depending on the size of the firing table, e.g., four, six or eight props are arranged in the normal case in two rows at spaced locations from one another, and the four outer props define a rectangle, which essentially corresponds to the shape and size of the firing table. Partial divisions are also possible.

The rails thus extend correspondingly between two, three, or four props arranged in one vertical plane and in pairs opposite each other in a horizontal plane. It is, however, also possible to provide additional props and rails in a vertical plane between the above-described two vertical planes.

It is important for the firing table structure that the rails arranged in parallel to and at spaced locations from one another in one horizontal plane be provided with a plurality of bearings (e.g., depressions) on their top edges, and that the bearings of adjacent rails be aligned with one another, so that one support roller can be placed in at least two bearings of adjacent rails. Besides the said form of depressions, the bearings may also have any other shape that makes it possible to drive or fix rollers as needed and which makes it possible to detach the rollers from the bearings in a simple manner.

Arranging in this manner a plurality of support rollers next to each other or one behind the other in a horizontal plane in order to provide a plane for accepting the items to be fired is not only within the scope of the present invention, but it also represents an advantageous embodiment.

The distance between the rollers and consequently the distance between the depressions thus depends above all on the size of the smallest item to be fired or the smallest support plate to be used.

The rollers shall not possibly rotate during the conveying of the firing table (with structure) to a kiln, through the said kiln, and out of the kiln to prevent the item to be fired from accidentally falling off; on the contrary, a stationary position of the rollers is desired during the conveying of the firing table.

This is achieved by using, e.g., materials with high surface roughness as the material for the rails and rollers. Since the firing table structure is to be made of refractory materials anyway, e.g., silicon carbide or materials based on SiC are proposed.

It is also obvious for the same reason to design the firing bench structure such that the support rollers extend in the direction of conveying of the kiln car and the loading and unloading are correspondingly performed at right angles thereto.

If the bearings (depressions) of the rails are designed as, e.g., semicircles, the support rollers, whose diameter should be equal to or somewhat smaller than the diameter of the depressions, are located securely and stationarily in the depressions. Other cross-sectional shapes of the depressions are, of course, also possible.

Nonrotatable supporting in the normal case and a possible ease of coupling to a drive member for loading and unloading are to be ensured.

However, the rollers shall also be able to be easily removed from the depressions in the upward direction. As will be described below, this is important for the loading and unloading of the firing table structure with items to be fired.

A mechanical tool, which has at least one means with which at least one support roller can be grasped and be set into rotary movement, is brought to the firing table for this purpose.

In the simplest case, this drive means comprises a sleeve made of a material with high static friction, which is attached to the corresponding end of the support roller in a nonpositive manner and is then driven.

It is obvious that not only one roller is thus to be set into rotary movement, but possibly all support rollers of one horizontal plane in one operation and at the same speed of rotation and in the same direction of rotation. However, it may also be sufficient to drive only every other or every third support roller if the item to be fired or the support plate for the item to be fired is so large that it always lies simultaneously on at least two driven rollers.

The item to be fired can thus be conveyed onto or removed from the firing table structure, as on a prior-art roller conveyor. The firing bench structure may be preceded or followed by a roller conveyor, on which the material is pretreated or aftertreated.

A roller drive is consequently brought according to the present invention to the firing table structure, and this roller drive sets the rollers into rotary movement and thus loads or unloads the items to be fired directly or indirectly (via support plates), doing so at a high speed, accuracy, and in a fully automated manner. The individual part does not need to be grasped and treated individually any more.

One special advantage is that the firing bench structure is provided with a plurality of "planes," i.e., a plurality of rails extend one above the other and thus they form a plurality of "loading planes," which can be filled and emptied in the same manner, with the corresponding rails between opposite props.

The torque may be transmitted from the drive means to the roller(s) in other ways as well. For example, the rollers may be slotted on the end side, and a corresponding tool, similar to a screwdriver, engages the slot for driving.

Other possibilities are formed by bayonet catches. All the conceivable forms of connection are available here to the person skilled in the art.

At any rate, it is advantageous for the ends of the support rollers to be driven to project to the outside beyond the corresponding support rail, because the connection to the drive means is thus facilitated.

A (synchronous) drive at both ends optimizes the automatic loading and unloading.

The device may be designed such that the support rollers are first slightly raised in order to more easily overcome the static friction and to keep the possible wear of the material low.

Corresponding devices from other fields of mechanical engineering, e.g., robots, which operate with high precision and ensure the desired roller drive, are available to the person skilled in the art in this case as well.

One special advantage of the new structure described for a firing table, such as a tunnel kiln car, is the fact that it now becomes possible for the first time ever to move the items to be fired over a very extensively uniform conveying system over the largest part of the processing until the removal after the firing, even though the other loading and unloading devices in the plant are designed and adapted correspondingly. The fact that the structure has a plurality of levels and is thus adapted to the other support means (shelves) in the plant plays an important role in this connection.

The items to be fired, e.g., porcelain, can thus be conveyed on roller conveyors or a roller conveyor-like device, such as the firing table structure being described here, from the drying (after the manufacture), via the glazing station, various storage means, a loading station, and the kiln up to the unloading and finishing and packaging.

BRIEF DESCRIPTION OF THE DRAWING

The firing table structure will be explained in greater detail below on the basis of a drawing. In the drawing.

DETAILED DESCRIPTION OF PREFERRED EMBODIMNENTS

According to the figures, a total of 6 props 12 *a–f* extend vertically upward from a firing bench 10. The props 12 *a–c*, just as the props 12 *d–f*, are arranged in a respective vertical plane. The distance between the props 12 *a, d* or 12 *c, f* is equal (and it approximately corresponds to the length L of the kiln car 10). The distance between the props 12 *a–c* and 12 *d–f* is also equal (and approximately corresponds to the width B of the kiln car 10). The corner props 12 *a, c, d* and *f* thus define a rectangle between them.

Figure 2:
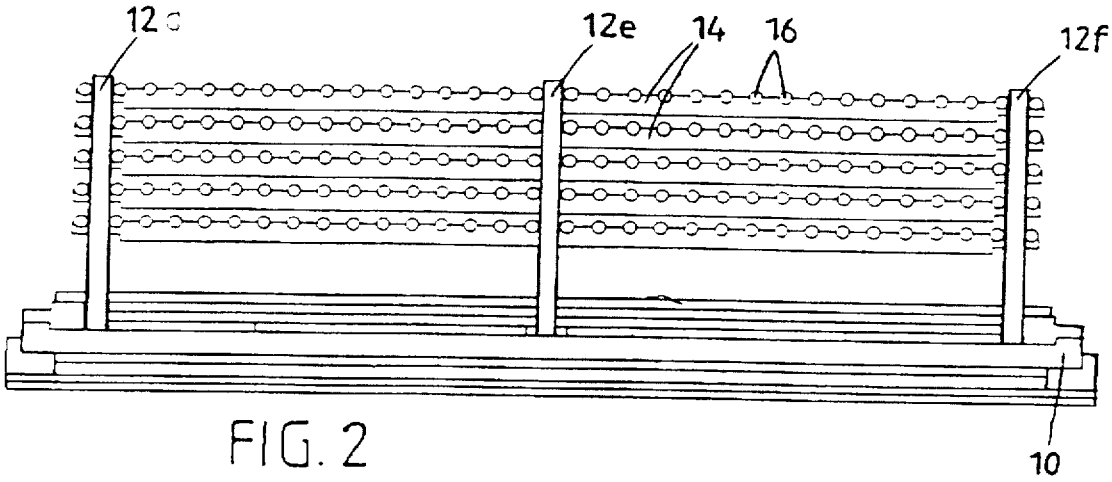
FIG. 2 shows a front view.
Figure 4:
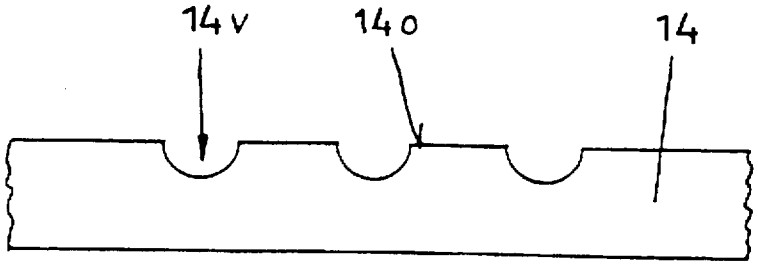
FIG. 4 shows a side view of a rail, always in highly schematic representations.

The figures, especially FIG. 2, also show the rails 14 extending between the rails 12 *a–c* and 12 *d–f*, whose depressions 14*v* (bearings) on the top edge 14*o* can be best recognized in FIG. 4.

A plurality of rails 14 are arranged along each prop 12 *a–f* at spaced locations one on top of another. A plurality of loading planes are thus formed. The distance is adjustable from one case to the next and is adapted to the actual conditions. If one plane is used to receive, e.g., coffee pots, the distance from the superjacent plane will be greater than in the case of a plane used to accept (flat) plates.

The rails 14 are rigidly connected to the props 12, either by corresponding fasteners, such as pins, by bonding or the like. A one-part design of the rails and props is also possible, in principle.

The props and rails may have, in principle, any desired cross section and consist of a great variety of materials. The goal is, however, to require as little mass as possible in order to have to heat the smallest possible amount of kiln furniture. On the other hand, the mechanical stability must be sufficient. Materials based on SiC proved to be suitable.

Figure 1:
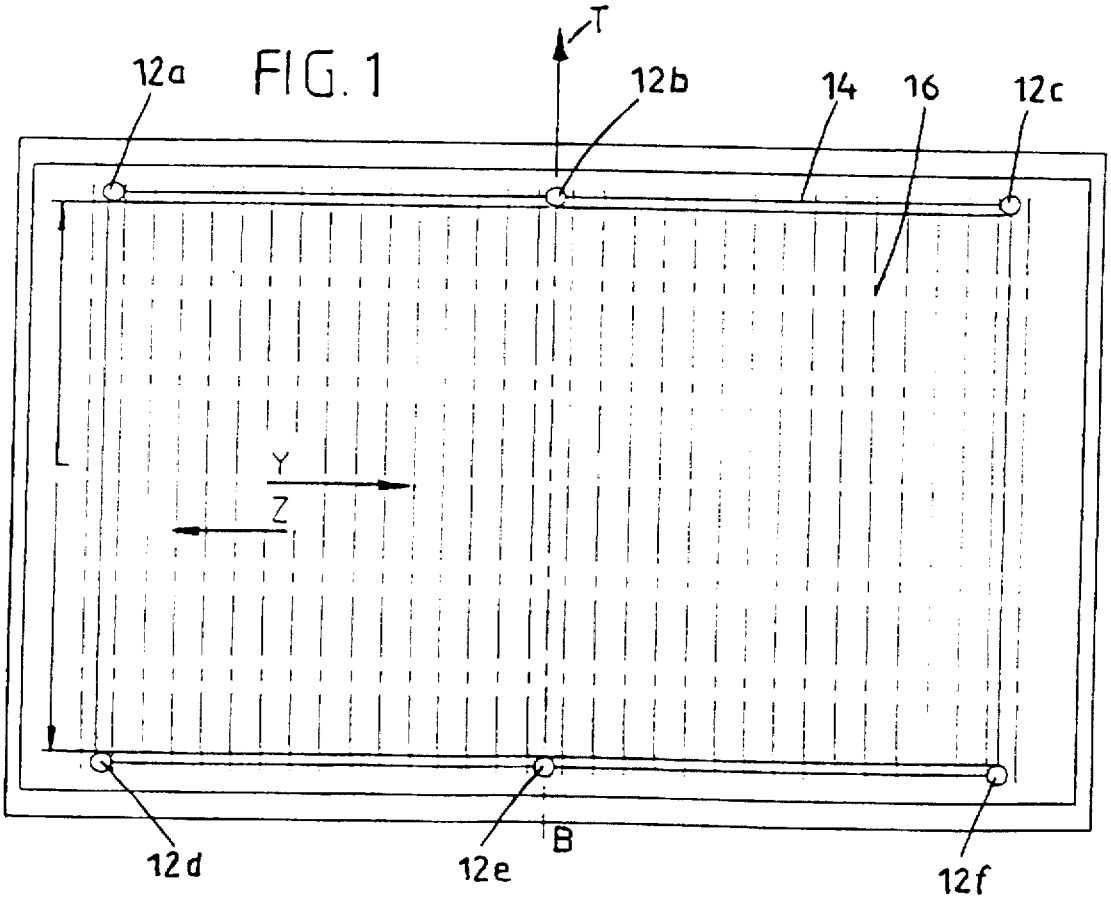
FIG. 1 shows a top view of the firing table structure.
Figure 3:
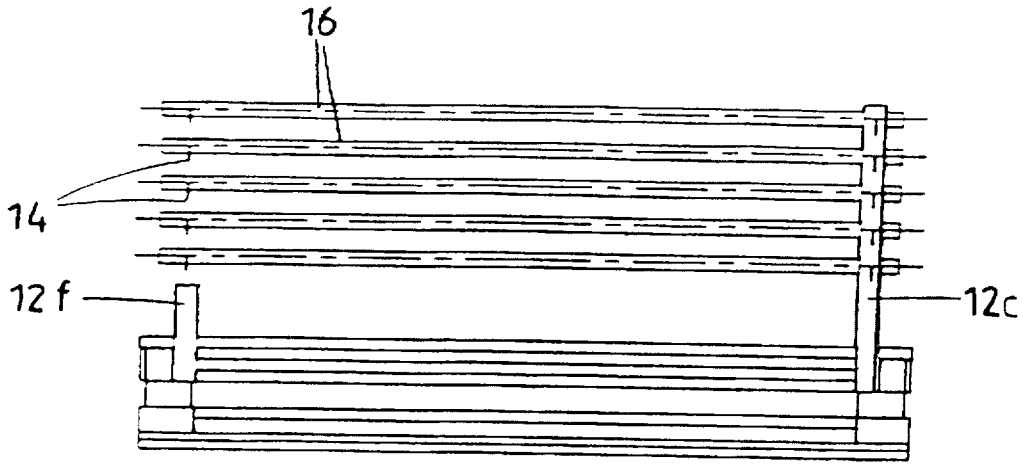
FIG. 3 shows a side view.

It can also be determined from the figures that support rollers 16, which are directed in the direction of conveying of the kiln car (arrow T in FIG. 1) and project over the rails 14 on the end side, are located in depressions 14*v* located opposite each other in pairs.

Corresponding to the above description of the loading and unloading of the firing bench structure, the loading and unloading is carried out here at right angles to the conveying direction T of the kiln car (arrows: T=loading and Y=unloading in FIG. 1).

We claim:

1. A firing table structure (10) for accepting ceramic items to be fired on a plurality of loading planes extending at vertically spaced locations from one another, having:

1.1. at least four props (12) located at spaced locations from one another, said props extending upwardly from said firing table (10), 1.2. at least two pair of said props (12) being connected by a plurality of rails (14) which are located one on top of another and are arranged at vertically-spaced locations from one another, 1.3. at least two of said rails (14) being arranged in a common horizontal plane, said rails extending parallel to and at horizontally-opposed spaced locations from one another, 1.4. said horizontally-opposed rails (14) being provided with a plurality of bearings (14*v*), each bearing being aligned with a bearing on the opposed rail, 1.5. a drivable support roller extending between and supported by said at least one pair of aligned bearings (14*v*), 1.6. said props (12), said rails (14), and said support rollers (16) consist of a refractory ceramic material.

2. Firing table structure in accordance with claim 1, in which the bearings (14*v*) consist of depressions on the top edge of the said rails (14).

* * * * *